United States Patent [19]

Butterwick

[11] 4,355,258

[45] Oct. 19, 1982

[54] PHOTOMULTIPLIER TUBE HAVING A STRESS ISOLATION CAGE ASSEMBLY

[75] Inventor: Gilbert N. Butterwick, Leola, Pa.

[73] Assignee: RCA Corporation, New York, N.Y.

[21] Appl. No.: 216,906

[22] Filed: Dec. 16, 1980

[51] Int. Cl.[3] ..... H01J 40/04; H01J 40/02

[52] U.S. Cl. ..... 313/95; 313/105 R

[58] Field of Search ..... 313/95, 105 R, 104

[56] References Cited

U.S. PATENT DOCUMENTS

| | | | |
|---|---|---|---|
| 2,451,850 | 10/1948 | McArthur | 313/95 |
| 2,818,520 | 12/1957 | Engstrom et al. | 313/95 |
| 2,952,499 | 9/1960 | Carson | 313/95 |

*Primary Examiner*—Robert Segal

*Attorney, Agent, or Firm*—Eugene M. Whitacre; Dennis H. Irlbeck; Vincent J. Coughlin, Jr.

[57] ABSTRACT

A photomultiplier tube comprises an evacuated envelope having a photoemissive cathode therein. A cage assembly including an anode and a plurality of closely spaced dynodes are within the envelope. The anode has at least one support rod. Each of the dynodes has a pair of dynode tabs formed in the ends thereof. A pair of dynode support spacers having a plurality of stress isolation apertures and electrode support apertures formed therethrough are provided for supporting the dynodes and the anode. The dynode tabs and the anode support rod extend through the electrode support apertures. A plurality of deformable stress isolation eyelets comprising a tubular shank with a flare formed in one end of the shank are disposed within a different one of the stress isolation apertures. The flare diameter is greater than the diameter of the stress isolation apertures thereby retaining the eyelets within the apertures. A second end of the tubular shank, opposite the flared end, extends outwardly from the dynode support spacers. The outwardly extending end portion is crimped to lock the eyelets within the stress isolation apertures. Nickel leads are provided for flexibly interconnecting the crimped end portion of a different one of each of the eyelets to one end of each of the dynodes and to one end of the anode support rod. A stem closes one end of the envelope. A plurality of relatively stiff cage assembly support leads extend through the stem and are welded to the crimped end portion of the eyelets thereby firmly securing the cage assembly to the support leads and indirectly connecting the support leads to the dynodes and the anode.

6 Claims, 4 Drawing Figures

PHOTOMULTIPLIER TUBE HAVING A STRESS ISOLATION CAGE ASSEMBLY

BACKGROUND OF THE INVENTION

The invention relates to a photomultiplier tube, and particularly to a structure for isolating the active electronic elements of the cage assembly of such a tube from mechanical stress induced by environmental factors.

The growing demand for petroleum products has placed increasing emphasis upon the need for improved oil exploration techniques. As the supply of easily obtainable oil dwindles, exploration has had to move to more remote geographical areas and to deeper fields. One technique for accurately determining the location, size and yield of an oil field is by oil-well logging. Logging is a term given to the method of determining the mineral composition and structure of the geological media along very deep holes. Sensitive probes, or sondes, are used to determine the lithology, i.e., the character of the rock formation, including the density, of the media along the bore hole. The bore holes are typically thousands of feet deep and may extend to about twenty thousand feet. Temperature increases with bore hole depth and the temperature in a twenty thousand feet deep hole may range between 100° to 250° C. In logging such a hostile environment, the sondes, which include a radioactive gamma ray source such as cesium 137 and a detector comprising a sodium iodide crystal and a photomultiplier tube, are subjected to shock and vibration in addition to high operating temperatures.

Gamma rays from the cesium 137 source enter the medium surrounding the bore hole, and interactions occur among the gamma rays and the orbital electrons in the atoms of the material comprising the medium. The interactions impart energy to the orbital electrons and redirect or scatter photons of lower energy than the incident gamma ray in a direction different from that of the incident gamma ray. This effect is called the Compton Effect. Some of the scattered photons are detected by the sodium iodide crystal which converts them to luminous scintillations. The luminous scintillations are then detected and converted into electrical pulses by the photomultiplier tube. The electrical pulses represent Compton photon energy data which may then be converted into a geological formation-density log. A more complete description of oil-well logging is contained in an article by G. N. Butterwick, entitled, "Oil Exploration With Photomultiplier Tubes", published in the RCA Engineer, pp. 62–65 (Vol. 24, No. 5, February/-March 1979).

Photomultiplier tubes used for oil-well logging are preferably small and rugged. The RCA C33016G photomultiplier tube, shown in FIG. 1, has a 25.4 mm diameter and a length of about 60 mm. It is well known in the art that the deleterious effects of shock and vibrations can be minimized by using stiff, short support leads connected directly to the active tube elements such as the anode and the dynodes to resist and quickly damp vibrations. Unfortunately, in photomultiplier tubes such as the C33016G, which has small electron multipliers with typical interelectrode spacings of about 0.1 mm between adjacent active multiplier elements, the stiff support leads expand as the sondes are lowered into the bore hole and the temperature increases and sometimes cause electrical shorts between the closely spaced active tube elements.

SUMMARY OF THE INVENTION

An improved photomultiplier tube of the type having an evacuated envelope includes a photoemissive cathode within the envelope and a cage assembly adjacent to the cathode. The cage assembly comprises an anode having at least one support rod and a plurality of closely spaced dynodes disposed between the cathode and the anode. Each of the dynodes has a pair of dynode tabs formed in the ends thereof. A pair of dynode support spacers having a plurality of stress isolation apertures and electrode support apertures formed therethrough are provided for supporting the dynodes and the anode. The dynode tabs and the anode support rod extend through the electrode support apertures. A plurality of deformable stress isolation eyelets are disposed within a different one of the stress isolation apertures. Means are provided for flexibly interconnecting a different one of each of the eyelets to one end of each of the dynodes and to one end of the anode support rod. A stem closes one end of the envelope. A plurality of relatively stiff cage assembly support leads extend through the stem. Means are provided for attaching a different one of the cage assembly support leads to each of the eyelets.

DETAILED DESCRIPTION OF THE PREFERRED EMBODIMENT

Figure 1:
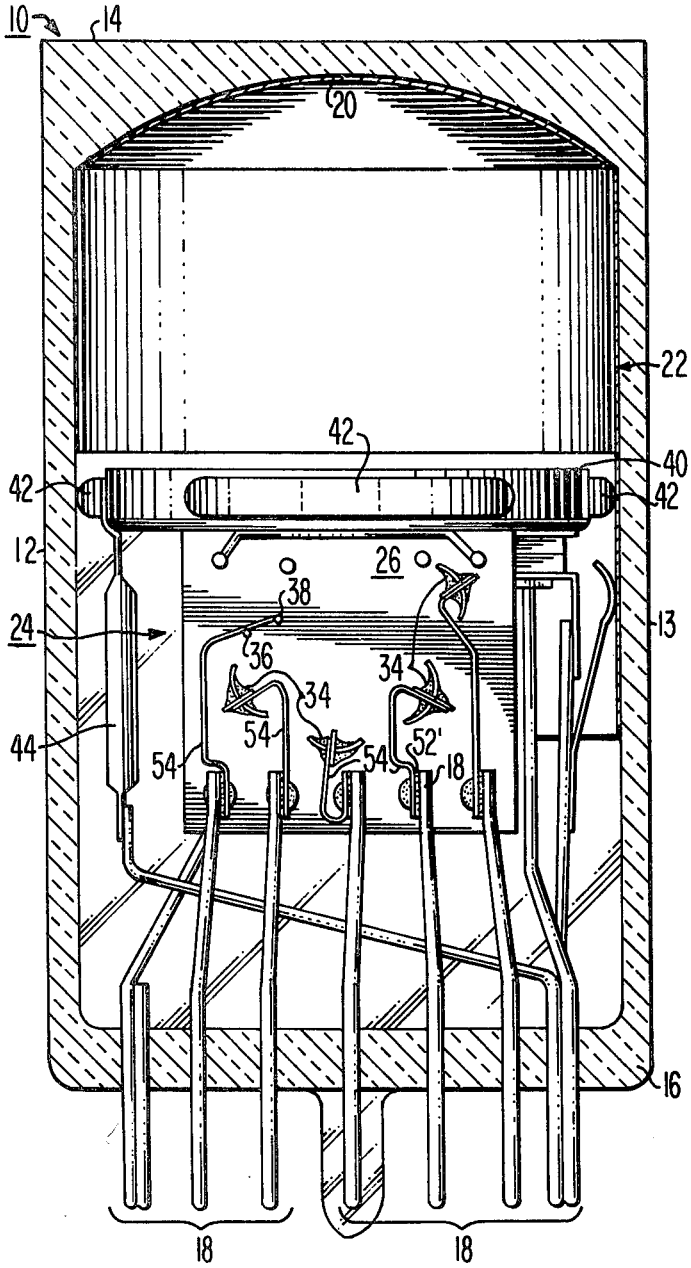
FIG. 1 is an enlarged plan view in axial section of a photomultiplier tube in which the present invention is incorporated.

Referring to the drawings, there is shown in FIG. 1 a photomultiplier tube 10 comprising an evacuated envelope 12 having a generally cylindrical sidewall 13, a transparent faceplate 14 and a stem 16, through which a plurality of relatively stiff conductive cage assembly support leads 18 are vacuum sealed. A photocathode 20 is formed on an interior surface of the faceplate 14. An aluminum coating 22 may be deposited on the upper inner surface of the envelope 12. The coating 22 makes electrical contact with the photocathode 20.

Figure 2:
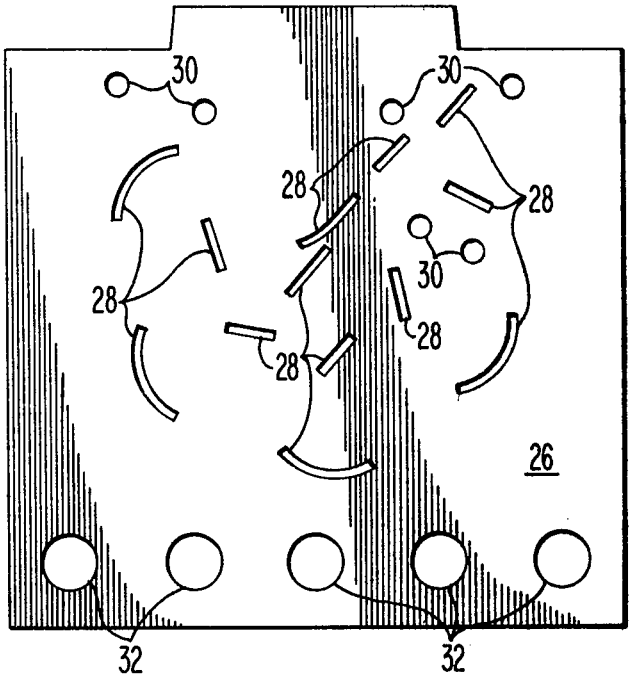
FIG. 2 is an enlarged plan view of a dynode support spacer having a plurality of stress isolation apertures therethrough.

A cage assembly, indicated generally as 24, is supported within the envelope 12 preferably by a pair of spaced substantially parallel ceramic dynode support spacers 26 (only one of which is shown). As shown in FIG. 2, each of the dynode support spacers 26 has a plurality of electrode apertures comprising elongated dynode support apertures 28 and small circular support rod apertures 30 extending therethrough. A row of stress isolation apertures 32 extends along the bottom of the support spacers 26. The cage assembly 24 includes a plurality of closely spaced dynodes (not shown) having a partially cylindrical cross-section and arranged in a circular configuration well known in the art and shown, for example, in U.S. Pat. No. 2,818,520 to R. W. Engstrom et al., issued on Dec. 31, 1957 and incorporated herein for disclosure purposes. An anode (also not shown) is substantially enclosed within the last dynode of the cage assembly 24. Each of the dynodes has a pair of oppositely disposed tabs 34 projecting from the ends thereof. Four of the tabs 34 are shown in FIG. 1. While only four dynode tabs are shown (the remaining five tabs extend from the opposite side of the cage assembly 24) the C33016G is a ten stage photomultiplier tube having nine dynodes and an anode. The dynode tabs 34 also have a slightly cylindrical shape and are formed, for example by crimping, to provide a substantially flat welding surface. Crimping of the tabs 34 also serves to lock the dynodes within the spacers 26. The anode is supported upon two support rods 36 and 38 the ends of which project from two of the support rod apertures 30 in support spacers 26.

A shield cup 40 having an aperture (not shown) is placed intermediate the photocathode 20 and the attached cage assembly 24 and maintained at a potential positive with respect to the photocathode 20 to enhance the collection and focusing of the photoelectrons emitted by the cathode 20 in response to incident radiation. A plurality of bulb spacers 42 are disposed circumferentially around the shield cup 40 to center the shield cup and the attached cage assembly 24. Within the shield cup 40 is an antimony source (not shown) which is used in conjunction with at least one alkali metal vapor source 44 to form the photocathode 20 and to activate the dynodes. While only one alkali metal vapor source is shown, two sources, one providing sodium vapor and the other providing potassium vapor are preferred to form a high temperature, stable, sodium-potassium-antimony photocathode 20.

In the prior art photomultiplier tube structures, such as that disclosed in the Engstrom et al. patent incorporated by reference herein, and in U.S. patent application, Ser. No. 182,768, filed on Aug. 29, 1980, entitled, "Evaporator Support Assembly For A Photomultiplier Tube" and assigned to the same assignee as the present invention, connections of the stem leads to the dynodes and anode are provided either by connecting rods having a diameter substantially equal to the diameter of the stem leads, or by directly connecting the stem leads to the dynode tabs and to the anode support rods. While such interconnecting structures pose no major problems for photomultiplier tubes of large size where the interelectrode spacings are relatively large, applicant has determined that this form of interconnection is unacceptable for small tubes which must operate at temperatures in excess of 150° C. At these high temperatures the relatively stiff leads 18 tend to expand and transmit motion to the dynodes and the anode. In the C33016G RCA photomultiplier tube the interelectrode spacing, between some electrodes, is about 0.1 mm. This close spacing between electrodes occasionally causes electrical shorts at high temperatures when the stem leads expand and force contact between adjacent dynodes or between the anode and the last dynode.

Figure 3:
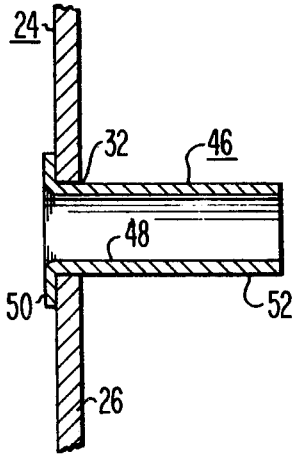
FIG. 3 is an enlarged section view of a stress isolation eyelet disposed within a stress isolation aperture.
Figure 4:
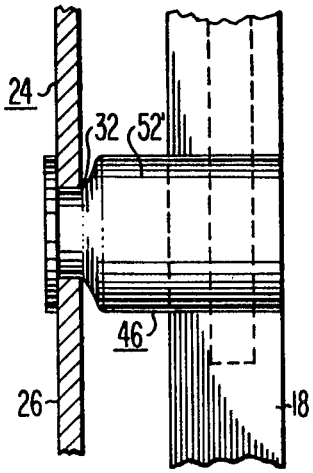
FIG. 4 is an enlarged section view of the eyelet of FIG. 3 subsequent to the crimping of the eyelet and the attaching of the connecting leads.

As shown in FIGS. 1 and 3–4, a novel stress isolation cage assembly 24 comprises a plurality of deformable stress isolation eyelets 46 disposed within the stress isolation apertures 32 of the dynode spacers 26. The eyelets are formed from hollow stainless steel tubing having a wall thickness of about 0.13 mm. The eyelets 46 comprise a tubular shank 48 having a flared end 50 with a diameter greater than the diameter of the stress isolation apertures 32 formed in the dynode support spacers 26. The flared end 50 retains the eyelet within the aperture 32. An end portion 52 of the shank 48 extends outwardly from the dynode support spacers 26. As shown in FIG. 4, the end 52 is crimped to form end portion 52' which locks the eyelet 46 within the aperture 32 of the support spacer 26. The crimped end portion 52' is preferably oriented along the longitudinal axis of the tube to facilitate the attaching, for example by welding, of one of the stem leads 18 to the crimped end portion. Ten of the stem leads 18, five of which are shown in FIG. 1, are cut to length and attached to the crimped end portion 52' of the stress isolation eyelets 46 as described above. Interconnection between the crimped end portions 52' and the dynode tabs 34 and the anode support rods 36 and 38 is provided by thin, relatively flexible connecting leads 54. The connecting leads 54 are provided with additional stress relief by forming the leads in such a manner that any change in length of the stem leads 18 is not passed directly to the connecting leads 54. As shown in FIG. 1, the connecting leads 54 do not extend directly between the crimped end portions 52' and the tabs 34 or support rods 36 and 38 but have bends therein to permit lead movement without transmitting the movement directly to the tabs and support rods. The thinness of the leads 54 also minimize the amount of stress that can be transmitted to the dynode tabs 34 and the support ends 36 and 38. In the preferred embodiment the connecting leads 54 are formed from 0.13 mm diameter nickel wire. The crimped end portions 52' of the eyelets 46 provide a broad flat contact surface that facilitates welding of the relatively stiff large support leads 18. The support lead 18 which are welded to the end portions 52' are typically trimmed to a length of about 8 mm to securely hold the cage assembly 24. The short lead length and stiffness of the leads 18 is required to minimize the deleterious effects of shock and vibration on the tube. In addition to providing a means for isolating mechanical stress transmitted through the leads 18 and firmly supporting the cage assembly 24 on the lead 18, the stress isolation eyelets 46 permit the welding parameters of temperature and pressure to be accurately tailored to the different materials and thickness of the support leads 18 and the connecting leads 54, thus providing a reliable weld.

What is claimed is:

1. In a photomultiplier tube having an evacuated envelope;

a photomissive cathode within said envelope, a cage assembly adjacent to said cathode, said cage assembly comprising;

i. an anode including at least one support rod, ii. a plurality of closely spaced dynodes disposed between said cathode and said anode, each of said dynodes having a pair of dynode tabs formed in the end thereof, iii. a pair of dynode support spacers having a plurality of electrode support apertures formed therethrough, said dynode tabs and said anode support rod extending through said electrode support apertures, and a stem closing one end of said envelope, said stem including a plurality of relatively stiff cage assembly support leads extending therethrough, the improvement comprising;

said dynode support spacers having a plurality of stress isolation apertures therethrough, a plurality of deformable stress isolation eyelets, each of said eyelets being disposed within a different one of said stress isolation apertures, means for flexibly interconnecting a different one of each of said eyelets to one end of each of said dynodes and to one end of said anode support rod, and means for attaching a different one of said cage assembly support leads to each of said eyelets.

2. In a photomultiplier tube having an evacuated envelope;

(a) a photoemissive cathode within said envelope, (b) a cage assembly adjacent to said cathode, said cage assembly comprising;

i. an anode including at least one support rod, ii. a plurality of closely spaced dynodes disposed between said cathode and said anode, each of said dynodes having a pair of dynode tabs formed in the ends thereof, iii. a pair of dynode support spacers having a plurality of electrode support apertures formed therethrough, said dynode tabs and said anode support rod extending through said electrode support apertures, and a stem closing one end of said envelope, said stem including a plurality of relatively stiff cage assembly support leads extending therethrough, the improvement comprising;

said dynode support spacers having a plurality of stress isolation apertures therethrough, a plurality of deformable stress isolation eyelets each of said eyelets being disposed within a different one of said stress isolation apertures, each of said eyelets comprising a tubular shank with a flare having a diameter greater than the diameter of said stress isolation apertures formed in one end thereof, said flare retaining said eyelets within said stress isolation apertures, said tubular shank have a second end portion opposite said flared end, said second end portion of said shank extending outwardly from said dynode support spacers, said outwardly extending end portion being crimped to lock said eyelets within said stress isolation apertures of said dynode spacers, means for flexibly interconnecting said crimped end portion of a different one of each of said eyelets to one end of each of said dynodes and to one end of said anode support rod thereby providing low stress electrical connections between said eyelets and said dynodes and said anode, and means for attaching a different one of said cage assembly support leads to said crimped end portion of each of said eyelets thereby firmly securing said cage assembly to said support leads.

3. The tube as in claim 2 wherein said plurality of stress isolation apertures comprise a row of apertures extending along the bottom of said pair of dynode support spacers.

4. The tube as in claim 2 wherein said stress isolation eyelets comprise hollow stainless steel tubing.

5. The tube as in claim 2 wherein said means for flexibly interconnecting comprises nickel wire.

6. The tube as in claim 5 wherein said nickel wire has a diameter of 0.13 mm.

* * * * *